US005820410A

United States Patent [19]

Genta et al.

[11] Patent Number: 5,820,410

[45] Date of Patent: Oct. 13, 1998

[54] ELECTRIC CONNECTOR

[75] Inventors: Alessandro Genta, Turin; Pier Carlo Bigotto, Rivoli, both of Italy

[73] Assignee: Framatome Connectors International S.A., Courbevoie, France

[21] Appl. No.: 809,783

[22] PCT Filed: Sep. 28, 1995

[86] PCT No.: PCT/EP95/03847

§ 371 Date: May 29, 1997

§ 102(e) Date: May 29, 1997

[87] PCT Pub. No.: WO96/10850

PCT Pub. Date: Apr. 11, 1996

[30] Foreign Application Priority Data

Sep. 30, 1994 [IT] Italy ..... TO94 A 000772

[51] Int. Cl.[6] ..... H01R 13/422

[52] U.S. Cl. ..... 439/595

[58] Field of Search ..... 439/595, 752

[56] References Cited

U.S. PATENT DOCUMENTS 4,253,718 3/1981 Bungo .
5,088,938 2/1992 Murakami et al. ..... 439/595
5,108,318 4/1992 Sakurai et al. ..... 439/595
5,445,541 8/1995 May et al. ..... 439/595
5,575,683 11/1996 Saito et al. ..... 439/595

FOREIGN PATENT DOCUMENTS 0 374 455 A2 6/1990 European Pat. Off. .

*Primary Examiner*—Gary F. Paumen
*Attorney, Agent, or Firm*—Pollock, Vande Sande & Priddy

[57] ABSTRACT

An electric connector presenting an insulating casing with at least one axial cavity; an electric terminal retained inside the cavity by an elastic lance; and a first movable element which snaps onto the casing to determine correct engagement and prevent disengagement of the elastic lance and the terminal; the first movable element also presenting a second movable element interposed between the first movable element and the terminal. The first movable element causes the second movable element to cooperate with and at least partly expel the terminal from the cavity in the event the elastic lance fails to correctly engage the terminal.

8 Claims, 3 Drawing Sheets

ELECTRIC CONNECTOR

FIELD OF THE INVENTION

The present invention relates to an electric connector, particularly of the type comprising an outer insulating casing defining at least one axial cavity, and an electric terminal housed and retained inside the cavity by primary retaining means.

BACKGROUND OF THE INVENTION

Electric connectors of the aforementioned type are known, which comprise a secondary retaining device for ensuring retention of the terminals inside the respective cavities.

The secondary retaining device normally comprises a movable element which snaps onto the outer casing, and which may either be hinged integrally with or formed separately from the casing. In either case, for the movable element to snap onto the casing, the terminal must first be inserted correctly inside the cavity and retained by the primary retaining means, which normally consist of an elastically deformable lance forming part of the casing. Any incorrect or incomplete insertion of the terminal, is detected by the primary retaining means being so deformed as to interfere with and prevent engagement of the movable element.

Known connectors, as disclosed in GB-A-2 170 962, DE-A-3 920 517 and DE-A-4 225 generally require testing apparatus, in order to detect assembly faults; however, even the use of such apparatus does not always prevent connection faults from arising.

A drawback of known connectors of the type briefly described above is that, in the event the terminal is not inserted fully inside the cavity, the movable element may be forced into engagement despite interference with the primary retaining means, as a result, for example of breakage or deformation of the contacting parts. Thus, incorrect assembly of the terminal may go unnoticed during testing because the terminal is so positioned as to establish at least a precarious electrical contact, which contact, however, is invariably interrupted, with obvious consequences, in applications in which the connector is subject to vibration, as on a motor vehicle.

SUMMARY OF THE INVENTION

It is an object of the present invention to provide an electric connector designed to overcome the aforesaid drawbacks typically associated with known connectors.

According to the present invention, there is provided an electric connector comprising an insulating casing with at least one axial cavity, at least one electric terminal housed inside the cavity and at least primary retaining means for retaining the terminal inside the cavity, and movable expulsion means cooperating with the terminal for at least partly expelling the terminal from the cavity in the event the primary retaining means fail to correctly engage the terminal.

BRIEF DESCRIPTION OF THE DRAWINGS

A preferred embodiment of the present invention will be described by way of example with reference to the accompanying drawings, in which.

DESCRIPTION OF PREFERRED EMBODIMENT

Figure 1:
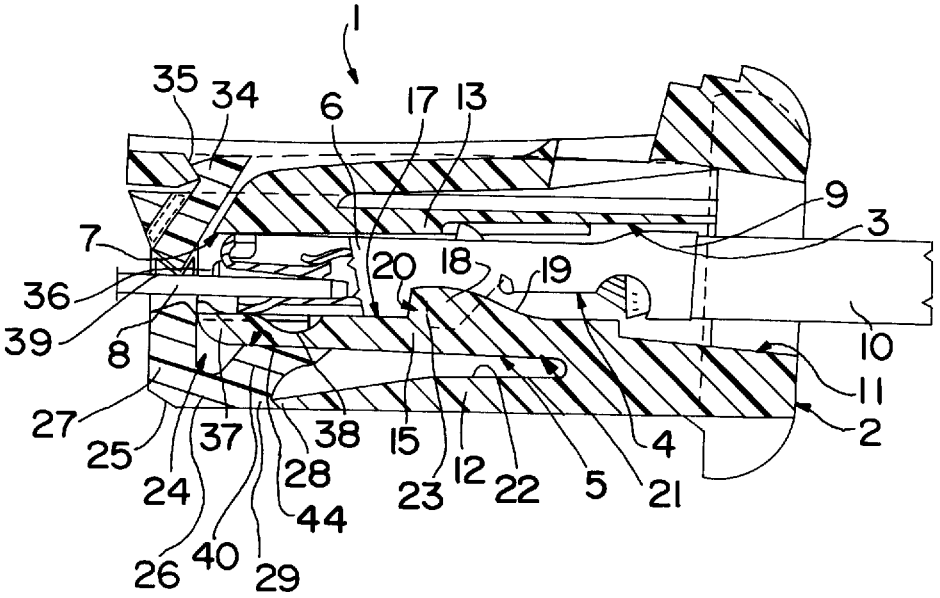
FIG. 1 shows an in-service longitudinal section of an electric connector in accordance with the present invention.
Figure 2:
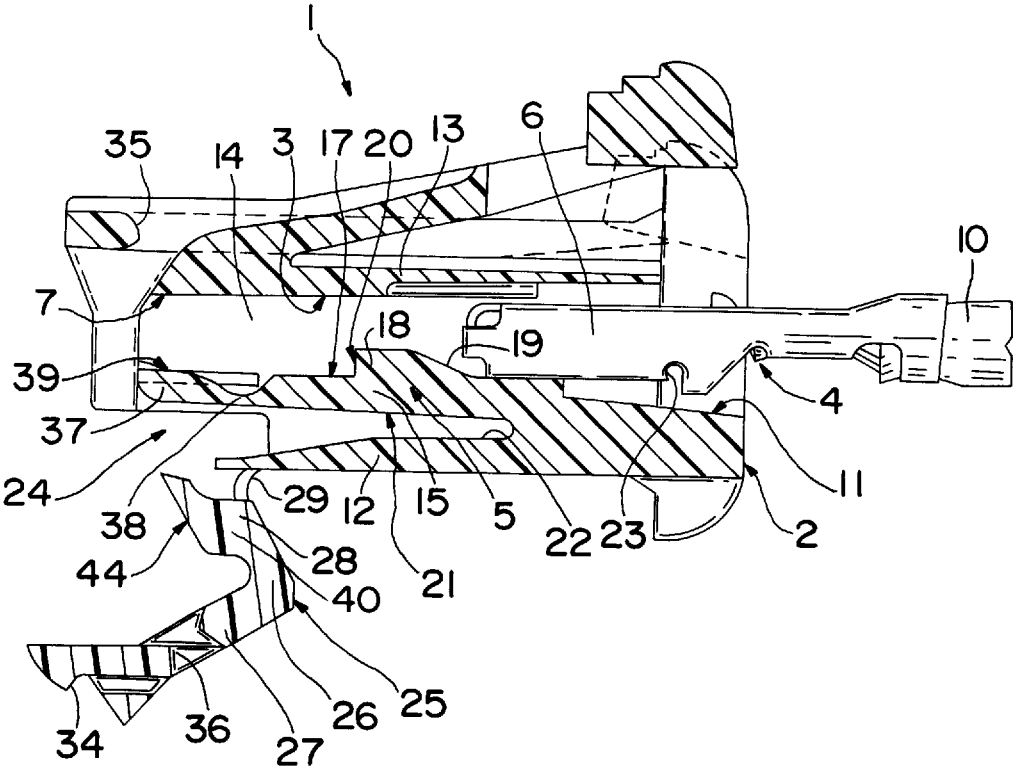
FIG. 2 shows a longitudinal section, as in FIG. 1, of the connector at the pre-assembly stage.

FIGS. 1 and 2 show an electric connector, which comprises an insulating casing 2 defining a number of longitudinal through cavities 3 (only one is shown), and a number of electric terminals 4 housed inside respective cavities 3 and retained therein by primary retaining means 5.

Each terminal 4 comprises a substantially box-shaped contact portion 6 located, in use, facing a front opening 7 in the cavity, through which to insert the male terminal 8 (shown partially) of a complementary connector, and a portion 9 for connection to an electric cable 10. Terminal 4 is inserted inside respective cavity 3 through a rear opening 11 in the cavity (FIG. 2) from which cable 10 extends in use.

Cavities 3 are defined by respective outer lateral walls 12, 13 of casing 2, and are separated by longitudinal partition walls 14.

Primary retaining means 5 comprise an elastic lance 15 projecting inside cavity 3 from lateral wall 12 and substantially longitudinally towards front opening 7. On surface 17 of lance 15 facing inwards of cavity 3, there is formed a substantially serrated tooth 18 presenting an inclined side 19 facing rear opening 11, and a side 20 substantially perpendicular to the axis of cavity 3 and facing front opening 7. Between lateral wall 12 and the opposite surface 21 of lance 15, there is formed a gap 22 for enabling lance 15 to flex towards wall 12.

Figure 3:
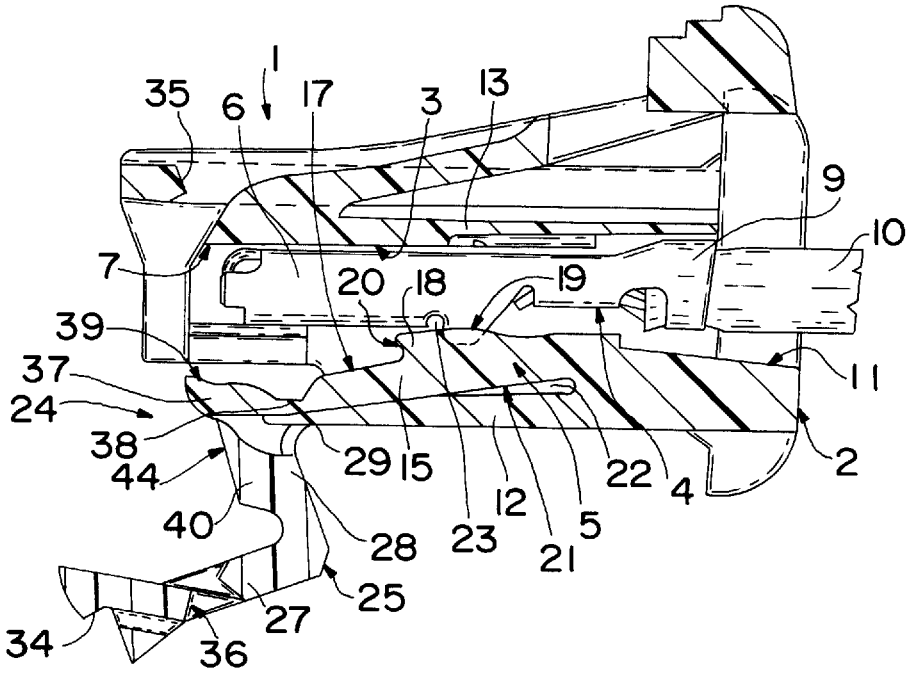
FIGS. 3, 4 and 5 show longitudinal sections, and as in FIG. 1, of various operating positions assumed by the connector during assembly, in the event of incomplete terminal insertion.
Figure 4:
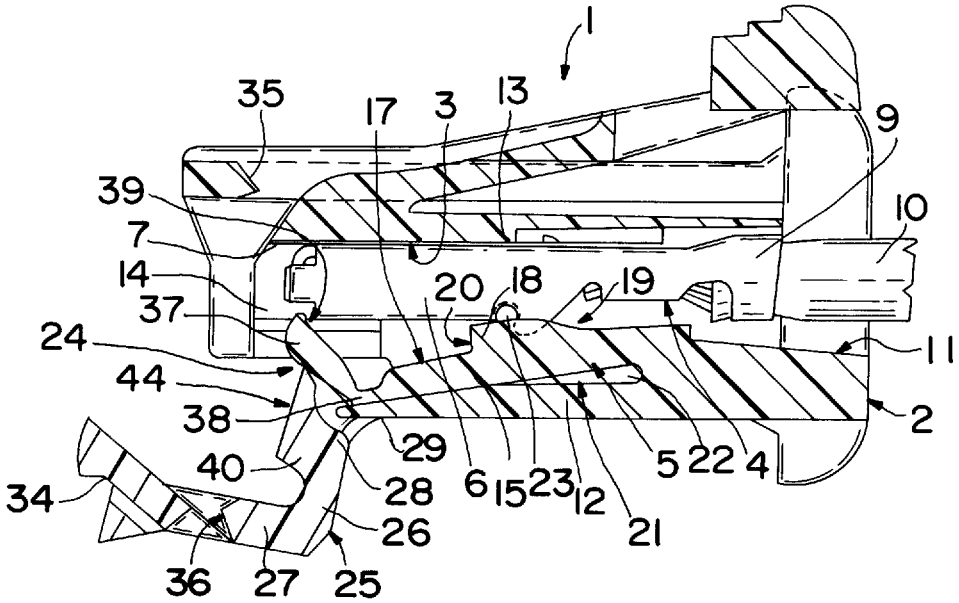

Tooth 18 therefore permits insertion of terminal 4 which, as it slides along side 19, flexes lance 15 towards wall 12 (FIG. 3). Once terminal 4 is inserted fully inside cavity 3 (FIG. 1), lance 15 springs back to its original position by tooth 18 snapping behind rear edge 23 of contact portion 6 of terminal 4 and so defining, with side 20, a stop for preventing withdrawal of terminal 4.

Connector 1 also presents a secondary retaining device 24 for retaining terminals 4.

Device 24 comprises a movable element 25 integral with and extending transversely over the entire width of casing 2, presenting a substantially L-shaped cross section, and in turn comprising a first wall 26 and a second wall 27 substantially perpendicular to each other. Wall 26 is hinged along its free edge 28 to the front end 29 of wall 12 of casing 2, and the free-edge of wall 27 presents a number of catch elements 34 designed to snap inside respective seats 35 formed in casing 2, close to the front edge of wall 13.

Element 25 is movable between an open position (FIG. 2) corresponding to the molding position of casing 2, and a closed position (FIG. 1) wherein wall 27 contacts the front end of casing 2. Wall 27 presents a number of openings 36 which are positioned facing front openings 7 of cavities 3 when element 25 is closed.

According to the present invention, device 24 comprises, for each cavity 3 a flexible portion 37 defined by the free end of lance 15 and connected integral with the rest of lance 15 by a small-section blade 38 which acts as a hinge for enabling portion 37 to flex inwards of cavity 3. Portion 37 presents a shaped surface 39 facing the axis of cavity 3 and cooperating with terminal 4, as described hereinbelow. When undeformed, portion 37 is aligned with the rest of lance 15, and surface 21 along the whole of lance 15, including blade 38 and portion 37, is flat.

At each cavity 3, element 25 presents an inner appendix 40 presenting a flat end surface 44 cooperating with surface 21 of lance 15 when element 25 is closed. Appendix 40 contacts lance 15 from an intermediate portion of portion 37 to a point beyond blade 38 towards the retaining section of lance 15.

Device 24 operates as follows.

When terminal 4 is correctly inserted inside cavity 3 (FIG. 1), it is retained by tooth 18; lance 15 is restored to its original undeformed position, and, when element 25 is closed and retained in the closed position by catch elements 34 engaging seats 35, appendix 40 fits inside gap 22 and rests against surface 21 of lance 15 for the dual purpose of preventing lance 15 from flexing and so releasing terminal 4, and for reinforcing the weaker portion of lance 15 defined by the smaller section of blade 38.

Conversely, when terminal 4 is inserted only partly, as shown in FIG. 3, lance 15 remains flexed, due to terminal 4 interfering with tooth 18.

Consequently, when element 25 is pushed towards the closed position, appendix 40 interferes with and flexes portion 37 of lance 15 inwards of cavity 3,; i.e. substantially rotates it about the virtual hinge defined by blade 38.

Figure 5:
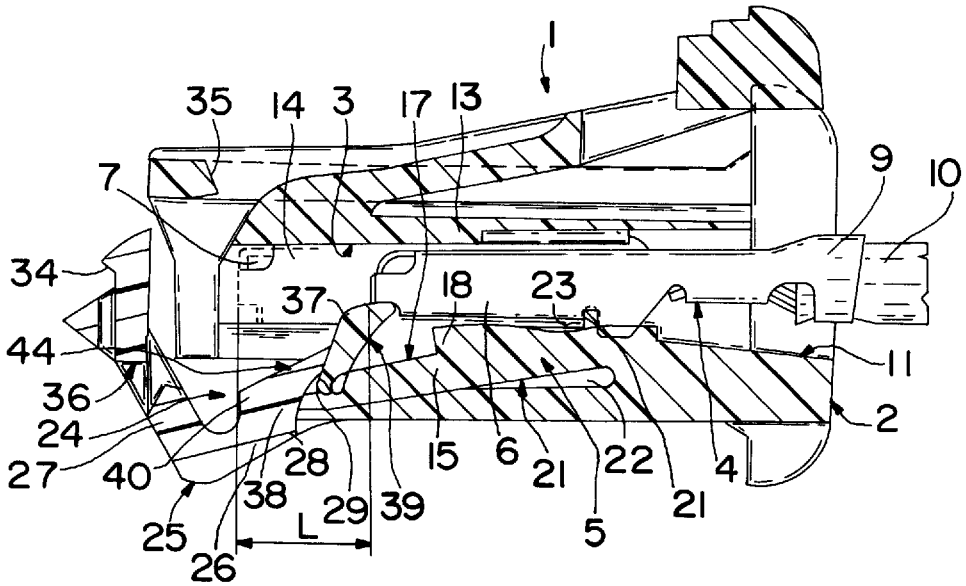

Upon surface 39 of portion 37 contacting the front edge of terminal 4, and upon element 25 being pushed further to further rotate portion 37, terminal 4 is pushed rearwards along cavity 3 (FIG. 5). The device is so sized as to push terminal 4 rearwards by a distance L—measured from the correct insertion position shown by the dotted line in FIG. 5—sufficient to prevent contact with a complementary terminal inserted inside the cavity, and element 25 is prevented from being closed by portion 37 being arrested, at the end of the expulsion stroke, against the rest of lance 15 and in turn constituting a stop for element 25.

The advantages of connector 1, and particularly device 24, according to the present invention are as follows.

If any one of the terminals is not inserted properly inside the cavity and retained by the primary retaining means, it is at least partly expelled from the cavity, so that, even if element 25 is forced into the closed position, the terminal is prevented from establishing any, even precarious, electrical contact, thus enabling the fault to be detected immediately when testing the electric system of which the connector forms part.

Connector 1 may comprise any number of terminals 4; terminals 4 may be of any type, male or female; and changes may be made in the design and location of portion 37 of the portion of the terminal with which portion 37 interacts.

We claim:

1. An electric connector comprising an insulating casing with at least one axial cavity;

at least one electric terminal housed inside said cavity, primary retaining means for retaining said terminal inside said cavity, movable expulsion means cooperating with said terminal for at least partly expelling said terminal from said cavity in the event said primary retaining means fail to correctly engage said terminal, and secondary retaining means including at least one first movable element designed to snap on to the casing in a closed position for preventing disengagement of said primary retaining means and said terminal, wherein said expulsion means include at least one second movable element interposed between said first movable element and said terminal, and said first movable element causes said second movable element to cooperate with said terminal when said first movable element is moved toward said closed, position.

2. The connector as claimed in claim 1, wherein said first movable element is integral with and substantially hinged to said casing.

3. The connector as claimed in claim 2, wherein said second movable element is integral with and substantially hinged to said casing.

4. The connector as claimed in claim 3, wherein said primary retaining means comprise an elastic lance which extends inside said cavity and which assumes a deformed position in the event said terminal is not fully inserted, said first movable element comprising at least one thrust portion cooperating with said elastic lance in said deformed position during closure of said first movable element.

5. The connector as claimed in claim 4, wherein said second movable element is defined by an end portion of said elastic lance, which is secured to the rest of the elastic lance by a small-section portion.

6. The connector as claimed in claim 5, wherein said end portion is rotated inward of said cavity by said thrust portion of said first movable element, so as to cooperate with and expel said terminal.

7. The connector as claimed in claim 5, wherein said thrust portion of said first movable element comprises a surface designed to contact said elastic lance when said first movable element is in a closed position and said elastic lance is in an undeformed position.

8. The connector as claimed in claim 1, wherein said first movable element comprises an appendix adapted to interfere with and rotate said movable expulsion means when said terminal is only partially inserted.

* * * * *